US007389756B2

(12) United States Patent
Hoppe et al.

(10) Patent No.: US 7,389,756 B2
(45) Date of Patent: Jun. 24, 2008

(54) CONTROL VALVE FOR AN APPARATUS FOR VARIABLE SETTING OF THE CONTROL TIMES OF GAS EXCHANGE VALVES OF AN INTERNAL COMBUSTION ENGINE

(75) Inventors: Jens Hoppe, Erlangen (DE); Ali Bayrakdar, Roethenbach/Pegnitz (DE)

(73) Assignee: Schaeffler KG (DE)

( * ) Notice: Subject to any disclaimer, the term of this patent is extended or adjusted under 35 U.S.C. 154(b) by 0 days.

(21) Appl. No.: 11/555,751

(22) Filed: Nov. 2, 2006

(65) Prior Publication Data

US 2007/0095315 A1 May 3, 2007

(30) Foreign Application Priority Data

Nov. 3, 2005 (DE) ..... 10 2005 052 481

(51) Int. Cl.
*F01L 1/34* (2006.01)

(52) U.S. Cl. ..... 123/90.17; 123/90.15; 123/90.31; 137/625.34

(58) Field of Classification Search ..... 123/90.15, 123/90.17, 90.31; 137/625.34; 251/129.2
See application file for complete search history.

(56) References Cited

U.S. PATENT DOCUMENTS 4,439,984 A * 4/1984 Martin ..... 60/454
5,289,805 A * 3/1994 Quinn et al. ..... 123/90.17
5,325,762 A * 7/1994 Walsh et al. ..... 91/275
6,026,772 A * 2/2000 Shirabe ..... 123/90.17
2004/0055551 A1 * 3/2004 Maeyama et al. ..... 123/90.17

* cited by examiner

*Primary Examiner*—Zelalem Eshete
(74) *Attorney, Agent, or Firm*—Lucas & Mercanti, LLP

(57) ABSTRACT

The invention relates to a control valve (20) for an apparatus (1) for the variable setting of the control times of gas exchange valves (110, 111) of an internal combustion engine (100), having a valve housing (22) of hollow configuration which has at least one inflow connection (P), at least one outflow connection (T) and at least two working connections (A, B), and having a control plunger (35). In order to retain relatively high flexibility in the design of the control valve components (22, 35) and to simplify the connection of the control valve (20) to the surrounding construction (3), it is proposed to arrange a pressure medium guide insert (27) of hollow configuration within the valve housing (22), and to form at least one pressure medium channel (34) which extends substantially in the axial direction, the pressure medium guide insert (27) engaging around the pressure medium channel (34) at least partially, the pressure medium channel (34) communicating with at least one of the connections (A, B, P, T) and, via a radial opening (33*b-d*), with the interior of the pressure medium guide insert (27), and the control plunger (35) being arranged within the pressure medium guide insert (27).

20 Claims, 5 Drawing Sheets

CONTROL VALVE FOR AN APPARATUS FOR VARIABLE SETTING OF THE CONTROL TIMES OF GAS EXCHANGE VALVES OF AN INTERNAL COMBUSTION ENGINE

FIELD OF THE INVENTION

The invention relates to a control valve for an apparatus for the variable setting of the control times of gas exchange valves of an internal combustion engine, having a valve housing of hollow configuration which has at least one inflow connection, at least one outflow connection and at least two working connections, and having a control plunger.

Camshafts are used in internal combustion engines for actuating the gas exchange valves. Camshafts are attached in the internal combustion engine in such a way that cams which are attached to them bear against cam followers, for example cup tappets, drag levers or valve rockers. If a camshaft is set in rotation, the cams roll on the cam followers which in turn actuate the gas exchange valves. Both the opening duration and the opening amplitude, but also the opening and closing instants of the gas exchange valves, are therefore fixed by the position and the shape of the cams.

Modern engine concepts tend toward designing the valve timing mechanism in a variable manner. Firstly, it is to be possible to design the valve stroke and valve opening duration in a variable manner, as far as the complete switching off of individual cylinders. For this purpose, concepts are provided such as switchable cam followers or electrohydraulic or electric valve actuating means. Furthermore, it has proven advantageous for it to be possible to influence the opening and closing times of the gas exchange valves during operation of the internal combustion engine. Here, it is particularly desirable for it to be possible to influence the opening and closing instants of the inlet and outlet valves in a separate manner, in order to set, for example, a defined valve overlap in a targeted manner. As a result of the setting of the opening and closing instants of the gas exchange valves as a function of the current characteristic diagram range of the engine, for example the current rotational speed or the current load, the specific fuel consumption can be lowered, the exhaust gas behavior can be influenced positively, and the engine efficiency, the maximum torque and the maximum power output can be increased.

The above-described variability of the gas exchange valve control times is achieved by a change in the relative phase position of the camshaft with respect to the crankshaft. Here, the camshaft is drive-connected to the crankshaft via a chain drive, belt drive, gear drive or drive concepts which function identically. An apparatus for the variable setting of the control times of an internal combustion engine, also called a camshaft adjuster in the following text, is attached between the chain drive, belt drive or gear drive which is driven by the crankshaft and the camshaft, which apparatus transmits the torque from the crankshaft to the camshaft. Here, this apparatus is configured in such a way that the phase position between the crankshaft and the camshaft can be maintained reliably during the operation of the internal combustion engine and, if desired, the camshaft can be rotated with respect to the crankshaft within a defined angular range.

In internal combustion engines having in each case one camshaft for the inlet and the outlet valves, they can be equipped with in each case one camshaft adjuster. As a result, the opening and closing instants of the inlet and outlet gas exchange valves can be displaced relative to one another and the valve overlaps can be set in a targeted manner.

Modern camshaft adjusters are usually seated at the drive-side end of the camshaft. However, the camshaft adjuster can also be arranged on an intermediate shaft, a non-rotating component or the crankshaft. Said camshaft adjuster comprises a drive wheel which is driven by the crankshaft and maintains a fixed phase relationship with respect to the latter, an output element which is drive-connected to the camshaft, and an adjusting apparatus which transmits the torque from the drive wheel to the output element. In the case of a camshaft adjuster which is not arranged on the crankshaft, the drive wheel can be configured as a chain sprocket, pulley wheel or gearwheel and is driven by the crankshaft by means of a chain drive, a belt drive or a gear drive. The adjusting mechanism can be operated electrically, hydraulically or pneumatically. Two preferred embodiments of hydraulically adjustable camshaft adjusters are represented by what are known as the axial plunger adjusters and rotational plunger adjusters.

In the axial plunger adjusters, the drive wheel is connected to a plunger and said plunger is connected to the output element, in each case via helical toothing systems. The plunger divides a hollow space which is formed by the output element and the drive wheel into two pressure chambers which are arranged axially with respect to one another. If one pressure chamber is loaded with pressure medium while the other pressure chamber is connected to a tank, the plunger is displaced in the axial direction. The axial displacement of the plunger is converted by the helical toothing systems into a relative rotation of the drive wheel with respect to the output element and therefore of the camshaft with respect to the crankshaft.

What are known as the rotational plunger adjusters are a second embodiment of hydraulic camshaft adjusters. In these, the drive wheel is connected fixedly in terms of rotation to a stator. The stator and a rotor or output element are arranged concentrically with respect to one another, the rotor being connected to the camshaft, an extension of the camshaft or an intermediate shaft in a force-transmitting, form-fitting or material-to-material manner, for example by means of a press fit, a screw connection or a welded connection. A plurality of hollow spaces which are spaced apart in the circumferential direction are formed in the stator, which hollow spaces extend radially outward starting from the rotor. The hollow spaces are delimited in a pressure-tight manner in the axial direction by side covers. A vane which is connected to the rotor and divides the respective hollow space into two pressure chambers extends into each of said hollow spaces. The phase of the camshaft relative to the crankshaft can be adjusted or maintained by a targeted connection of the individual pressure chambers to a pressure medium pump or to a tank.

In order to control the camshaft adjuster, sensors detect the characteristic data of the engine, such as the load state and the rotational speed. These data are fed to an electronic control unit which, after comparison of the data with an engine data map of the internal combustion engine, controls the inflow and the outflow of pressure medium to/from the different pressure chambers.

In order to adjust the phase position of the camshaft with respect to the crankshaft, one of the two pressure chambers, which act counter to one another, of a hollow space is connected to a pressure medium pump and the other is connected to the tank in hydraulic camshaft adjusters. The inflow of pressure medium to one chamber in conjunction with the outflow of pressure medium from the other chamber displaces the plunger which divides the pressure chambers in the axial direction, as a result of which the camshaft is rotated relative to the crankshaft via the helical toothing systems in axial plunger adjusters. In rotational plunger adjusters, a displacement of the vane and therefore directly a rotation of the camshaft with respect to the crankshaft is brought about by the pressure loading of one chamber and the pressure relief of the other chamber. In order to maintain the phase position, both pressure chambers are either connected to the pressure medium pump or are separated both from the pressure medium pump and from the tank.

The pressure medium flows to and from the pressure chambers are controlled by means of control valves, usually by means of a 4/3-way proportional valve. The latter has a valve housing which is provided with in each case one connection for the pressure chambers (working connection) and at least two supply connections. At least one of the supply connections serves as inflow connection, via which pressure medium is fed to the control valve by a pressure medium pump. Furthermore, a further supply connection serves as an outflow connection, via which the pressure medium which emerges from the pressure chambers is discharged. Here, there can be provision, for example, for the outflow connection to communicate with a tank.

An axially displaceable control plunger is arranged within the valve housing which is of substantially hollow-cylindrical configuration. The control plunger can be moved axially into every position between two defined end positions, counter to the spring force of a spring element, by means of an electromagnetic, pneumatic or hydraulic adjusting unit. Furthermore, the control plunger is provided with control sections, which have control edges, and annular grooves, as a result of which the connections can be connected to one another or can be shut with respect to one another. By targeted connection of the working connections to the supply connections, the individual pressure chambers or groups of pressure chambers can therefore optionally be connected to the pressure medium pump or the tank. A position of the control plunger can likewise be provided, in which the pressure medium chambers are separated both from the pressure medium pump and from the pressure medium tank.

A control valve of this type is known from DE 199 44 535 C1. It comprises a valve housing of substantially hollow-cylindrical configuration and a control plunger which is arranged axially displaceably therein. Two radial working connections, a radial inflow connection and an axial outflow connection are formed on the valve housing. The two working connections and the inflow connection are formed as openings, which are spaced apart axially with respect to one another, in the cylindrical circumferential surface of the valve housing. Here, the inflow connection lies in the axial direction between the two working connections.

A control plunger which can be displaced in the axial direction relative to the valve housing by means of an electromagnetic adjusting unit is provided within the valve housing. An annular groove is formed on the outer circumferential surface of the control plunger, via which annular groove, as a function of the position of the control plunger with respect to the valve housing, either the first or the second working connection can be connected selectively to the inflow connection.

As a function of the relative position of the control plunger within the valve housing, the outflow connection can be connected via further annular grooves and an axial hole within the control plunger either to the first or to the second working connection.

The control valve is configured as a central valve, that is to say the control valve is arranged radially within the output element of the camshaft adjuster. Here, the valve housing is configured in one piece with a central screw, by means of which the output element of the camshaft adjuster is connected fixedly in terms of rotation to a camshaft.

The position of the inflow connection between the working connections requires a complicated configuration of a supply line for feeding in pressure medium to the inflow connection of the control valve. This is realized by means of a plurality of holes which are formed in the valve housing, opening into one another and communicate with a hole in the screw shaft of the central screw, the latter in turn opening into the camshaft of hollow configuration. The interior of the camshaft is loaded with pressure medium by a pressure medium pump via a camshaft bearing.

The configuration of said holes in the wall of the valve housing is very expensive and susceptible to faults. In addition to the high manufacturing expenditure of the thin holes within the thin-walled valve housing, which leads to a considerable contribution to production costs, production rejects increase in this embodiment on account of faulty or non-aligned holes. Moreover, the process reliability suffers, as the thin drill bits tend to break during the formation of the holes, which leads to a further increase in the reject quota and further increased production costs.

SUMMARY OF THE INVENTION

The invention is therefore based on the object of avoiding these described disadvantages and thus of providing a hydraulic control valve, in which a very wide variety of pressure medium logics can be realized between the different connections without significant additional expenditure. Specifically, it is to be achieved that a simple and inexpensive configuration of a central valve and the associated supply lines is made possible irrespectively of the axial arrangement of the pressure medium connections at the valve housing. Here, a very high degree of freedom is to be achieved in the design of the pressure medium logics of the control valve, without increasing the requirement for installation space, the manufacturing complexity or the manufacturing costs significantly.

According to the invention, this object is achieved in that a pressure medium guide insert of hollow configuration is arranged within the valve housing, and at least one pressure medium channel is formed which extends substantially in the axial direction, the pressure medium guide insert engaging around the pressure medium channel at least partially, the pressure medium channel communicating with at least one of the connections and, via a radial opening, with the interior of the pressure medium guide insert, and the control plunger being arranged within the pressure medium guide insert.

There is provision in one advantageous development for the external dimensions of the pressure medium guide insert to be adapted to the internal dimensions of the valve housing, and for the pressure medium channel to be formed at the interface between the valve housing and the pressure medium guide insert.

There is provision in a further concrete embodiment of the invention for the apparatus to be fastened to a camshaft by means of a central screw, and for the valve housing to be configured in one piece with the central screw.

In a first embodiment, the at least one pressure medium channel is configured as a depression on an inner circumferential surface of the valve housing, an outer circumferential surface of the pressure medium guide insert delimiting the pressure medium channel radially inward, and the interior of the pressure medium guide insert communicating with the pressure medium channel via a radial opening which is formed on said pressure medium guide insert.

There is provision in a further embodiment for the at least one pressure medium channel to be configured as a depression on an outer circumferential surface of the pressure medium guide insert, an inner circumferential surface of the valve housing delimiting the pressure medium channel radially outward, and the pressure medium channel communicating with the interior of the pressure medium guide insert via a radial opening which is formed on said pressure medium guide insert.

Here, it is conceivable to configure the pressure medium guide insert in one piece and from steel or plastic.

There is provision in a further embodiment for the pressure medium guide insert to comprise at least one inner and one outer sleeve-shaped component, and for the at least one pressure medium channel to be configured as a slot in a wall of the outer sleeve-shaped component of the pressure medium guide insert, an inner circumferential surface of the valve housing delimiting the pressure medium channel radially outward and the inner sleeve-shaped component of the pressure medium guide insert delimiting the pressure medium channel radially inward, and the pressure medium channel communicating with the interior of the pressure medium guide insert via a radial opening which is formed on the inner sleeve-shaped component.

There can be provision here for the inner sleeve-shaped component to be manufactured separately with respect to the outer sleeve-shaped component and to be connected to the latter by means of a force-transmitting or form-fitting connection or an adhesive bond.

As an alternative, there is provision for the outer sleeve-shaped component to be manufactured as an injection molded part and for the inner sleeve-shaped component to be configured as an insert component which is encapsulated by the outer sleeve-shaped component during the injection molding process of the latter.

There is provision in one concrete embodiment of the invention for the pressure medium channel to connect the inflow connection to the interior of the pressure medium guide insert.

Here, a nonreturn valve and/or a filter element can be arranged within the control valve upstream of the pressure medium channel in one advantageous development of the invention.

Furthermore, there can be provision for the filter element and/or parts of the nonreturn valve to be connected to the pressure medium guide insert with a material-to-material fit.

In addition or as an alternative, there can be provision for the nonreturn valve to have a closing body which is loaded with a force by a spring element, the spring element being supported on a spring bearing which is configured in one piece with the pressure medium guide insert. In an alternative embodiment, the nonreturn valve has a closing body which is loaded with a force by a spring element, a spring bearing and a valve seat, at least the spring bearing or the valve seat being configured as a component which is separate from the pressure medium guide insert.

A plunger compression spring element can likewise be provided which loads the control plunger with a force in an axial direction, said plunger compression spring element being supported on a plunger spring bearing which is configured in one piece with the pressure medium guide insert or on a plunger spring bearing which is configured separately from the pressure medium guide insert.

There is provision in one concrete embodiment of the invention for both a plunger spring bearing and a spring bearing which is configured in one piece with the former to be provided.

It is proposed in one development of the invention to arrange the pressure medium guide insert within the valve housing in a stationary manner with respect to the valve housing, it being possible for form-fitting means to be provided for this purpose on the pressure medium guide insert and on the valve housing, which form-fitting means serve to fix the pressure medium guide insert axially with respect to the valve housing and/or to fix it in a stationary manner in the circumferential direction.

The control valve according to the invention is distinguished by the fact that the control plunger does not bear directly against an inner circumferential surface of the valve housing, but that a pressure medium guide insert is arranged between said components. Furthermore, in this embodiment, the valve housing serves as connecting element of the control valve to the surrounding constructions. It produces the connection to the pressure medium lines which are formed, for example, in an output element of a camshaft adjuster and lead to the hydraulic consumers (pressure chambers). Furthermore, the connection to at least one supply line, such as an inflow line or an outflow line, is produced via the valve housing, which supply lines can be formed, for example, in a camshaft or a connecting component.

Firstly, the pressure medium guide insert performs the function of connecting its interior to at least one of the connections via at least one substantially axially extending pressure medium channel. Furthermore, the pressure medium guide insert, together with the control plunger, fulfills the control function of the pressure medium flows within the valve. For this purpose, the control plunger is arranged axially displaceably within the pressure medium guide insert, control sections being formed on the control plunger, the external dimensions of said control sections being adapted to the internal dimensions of the pressure medium guide insert. The various radial openings which communicate with the individual connections can be connected or separated from one another by axial displacement of the control plunger relative to the pressure medium guide insert.

A very wide range of pressure medium logics can be realized within the control valve by the configuration of the substantially axially extending pressure medium channels within the control valve, neither the requirement for installation space nor the manufacturing costs or the manufacturing complexity being influenced negatively. In this way, the surrounding constructions no longer have to be adapted to the valve housing. In contrast, with only small additional expenditure, the position of the connections on the valve housing can be adapted to the surrounding constructions. The complicated pressure medium lines within the output element or the complicated holes which are proposed in the prior art and are greatly susceptible to faults are replaced by structures which are simple to manufacture and are formed on the pressure medium guide insert or the pressure medium guide insert and the valve housing.

In the case of a central valve which is arranged radially within an output element, the pressure medium feed line, for example, can be simplified considerably by the control valve according to the invention. Here, the pressure medium guide insert assumes the task of feeding the pressure medium which is fed to the inflow connection to the region of action of the control plunger at a location which lies axially between the two working connections. Instead of the holes which are to be manufactured in an expensive and complicated manner within the output element or the valve housing, the pressure medium can be guided via the structures of the pressure medium guide insert which are simple to manufacture.

These pressure medium channels can be formed, for example, at the interface between the pressure medium guide insert and the valve housing. For this purpose, depressions or axial grooves are provided on the pressure medium guide insert or the valve housing, which depressions or axial grooves communicate firstly with one of the connections and secondly with the interior of the pressure medium guide insert via suitable radial openings. The depressions which are formed on the pressure medium guide insert can be made in a cost-neutral manner in the pressure medium guide insert during the manufacturing process of the latter. If the pressure medium guide insert is configured from plastic, this can be achieved, for example, by the pressure medium channels already being considered in the injection mold. Pressure medium guide inserts which consist of steel or another metal, for example aluminum, are likewise conceivable. In this context, material-removing shaping or manufacture in a suitable metal injection molding process would be conceivable. The formation of the pressure medium guide insert from a steel sheet by means of a forming process without cutting, such as a deep drawing process, is likewise conceivable, it being possible in this case for the pressure medium channels to be formed once again in a cost-neutral manner during the shaping process.

In addition to the embodiment, in which the inflow connection communicates with the interior of the pressure medium guide insert via the pressure medium channels, other oil logics can also be realized, such as a connection of the interior of the pressure medium guide insert to the outflow connection or one or more of the working connections. In this context, it is only important that it is ensured that the pressure medium channels communicate exclusively with the provided connections, the pressure medium being guided past the other connections which lie in the axial region of the pressure medium channels, without a direct connection to the latter existing.

In addition to a one-piece configuration of the pressure medium guide insert, multiple-piece embodiments are also conceivable. For example, an inner and an outer component could be provided, the inner component being arranged within the outer component. The pressure medium channels are formed in the outer component, while the inner component delimits them with respect to the interior of the pressure medium guide insert and carries the radial opening for introducing the pressure medium into the interior of the pressure medium guide insert. In this case, the inner component can be, for example, a steel sleeve which is manufactured without cutting, and the outer component can be manufactured from plastic by means of an injection molding process. Here, the steel sleeve acts as an insert part which is encapsulated by the outer component during the manufacturing process of the latter. Other material pairings and force-transmitting, form-fitting or material-to-material connections or adhesive bonds are likewise conceivable.

Filter elements or nonreturn valves can be arranged within the control valve. These can be configured separately from the components of the control valve and connected with a material-to-material fit to one or more components, or be designed as an insert part. Embodiments are likewise conceivable, in which at least parts of the nonreturn valve or of the filter element are configured in one piece with components of the control valve. For example, in the case of a pressure medium guide insert or an inner component made from steel sheet, there can be provision for a spring bearing of the nonreturn valve to be configured in one piece with the respective component, as a result of which a further cost reduction can be achieved.

As pressure medium channels and radial openings are arranged alternately in the circumferential direction of the control valve, between which there is to be no direct connection, the pressure medium guide insert has to be mounted in the valve housing in a defined orientation of the components with respect to one another. In order to make oriented mounting easier and to preclude erroneous mounting, it is proposed to provide form-fitting elements on the pressure medium guide insert and the valve housing in the manner of a tongue/groove connection, as a result of which the pressure medium guide insert can be introduced into the valve housing only in one orientation. During the operation of the internal combustion engine, said tongue/groove connections additionally function as an antirotation safeguard.

BRIEF DESCRIPTION OF THE DRAWINGS

Further features of the invention result from the following description and from the drawings, in which exemplary embodiments of the invention are shown in simplified form and in which.

DETAILED DESCRIPTION OF THE DRAWINGS

Figure 1:
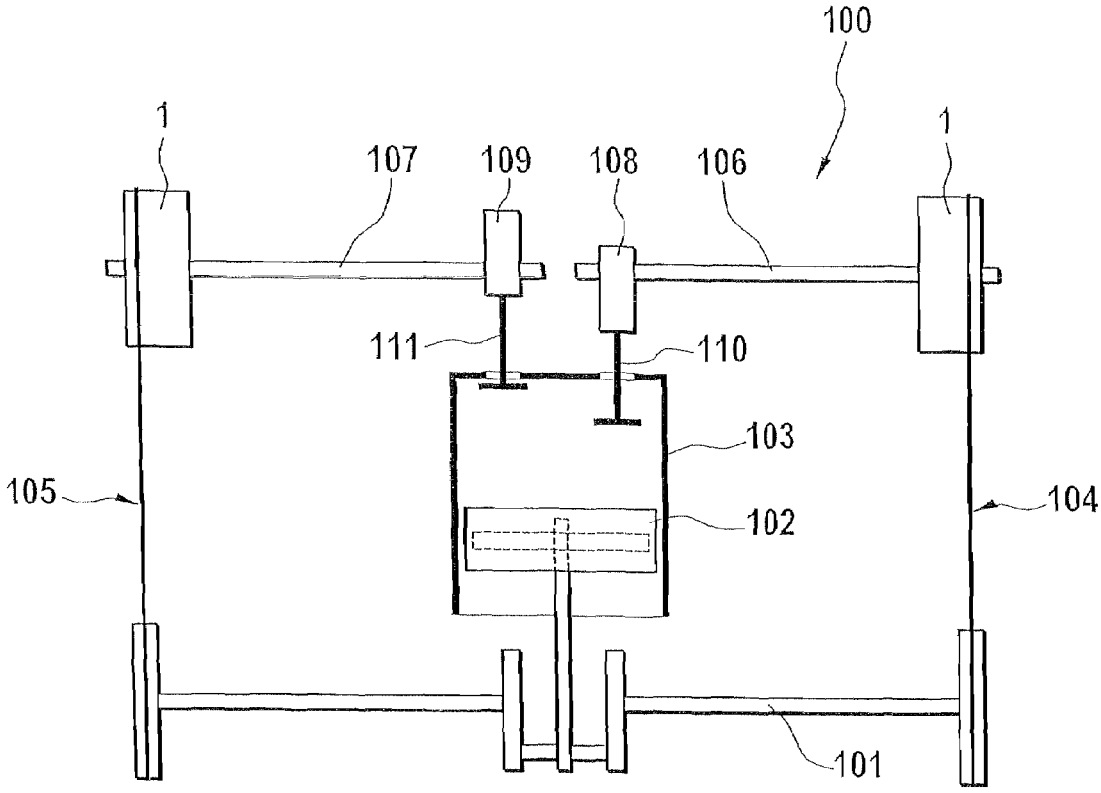
FIG. 1 shows an internal combustion engine only very diagrammatically.

FIG. 1 outlines an internal combustion engine 100, a plunger 102 being indicated in a cylinder 103, which plunger 102 is seated on a crankshaft 101. The crankshaft 101 is connected via in each case one flexible drive 104 and 105 to an inlet camshaft 106 and an outlet camshaft 107, respectively, in the embodiment shown, a first and a second apparatus 1 being able to ensure a relative rotation between the crankshaft 101 and the camshafts 106, 107. Cams 108, 109 of the camshafts 106, 107 actuate an inlet gas exchange valve 110 and an outlet gas exchange valve 111, respectively. There can likewise be provision for only one of the camshafts 106, 107 to be equipped with an apparatus 1, or for only one camshaft 106, 107 to be provided which is provided with an apparatus 1.

Figure 2B:
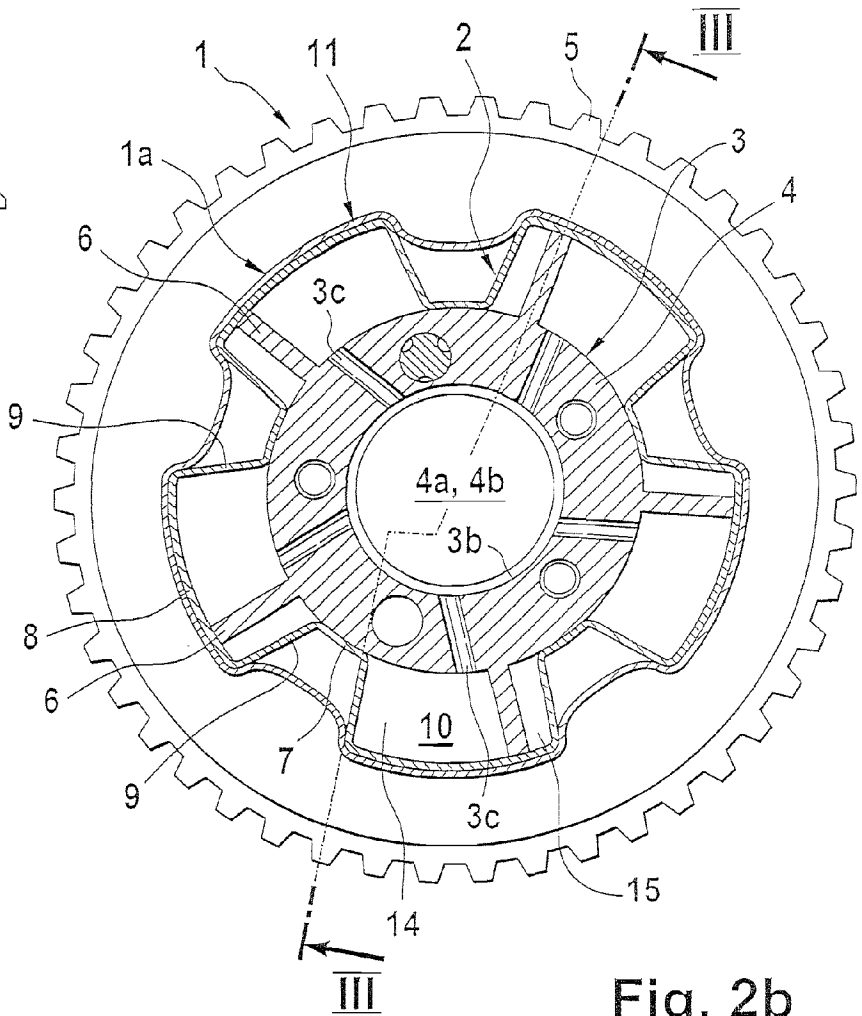
FIG. 2*b* shows a cross section through the apparatus from FIG. 2*a*, without a control valve, along the line IIB-IIB.
Figure 2A:
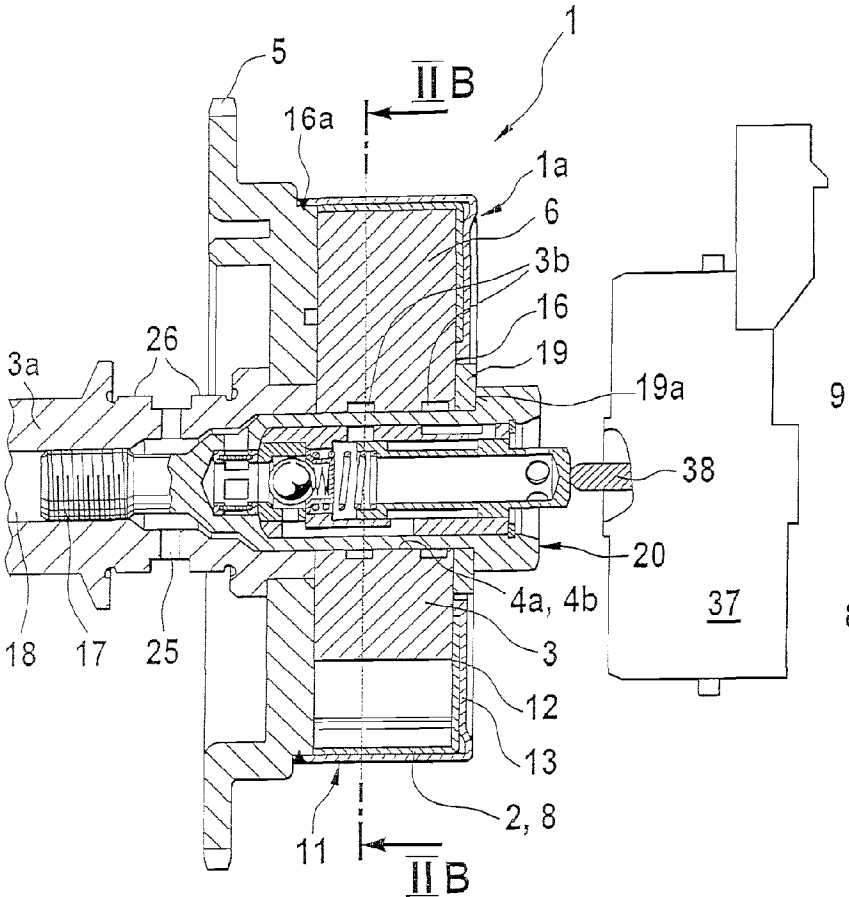
FIG. 2*a* shows a longitudinal section through an apparatus for the variable setting of the control times of an internal combustion engine, having a control valve according to the invention.

FIGS. 2*a*, 2*b* show a first embodiment of an apparatus 1 for the variable setting of the control times of gas exchange valves 110, 111 of an internal combustion engine 100.

An adjusting apparatus 1*a* comprises substantially a drive wheel 5, a stator 2 and an output element 3 which is arranged concentrically with respect to the latter. The output element 3 comprises a wheel hub 4, on the outer circumference of which five vanes 6 are formed which extend radially outward. Furthermore, the adjusting apparatus 1*a* is provided with a central hole 4*b*, into which, in the mounted state of the apparatus 1, a camshaft 3*a* engages, from the left in the illustration of FIG. 2*a*. In the mounted state of the apparatus 1, the latter can be connected fixedly in terms of rotation to the camshaft 3*a*, for example by means of a force-transmitting, frictional, form-fitting or material-to-material connection or by means of fastening means. In the embodiment shown, the apparatus 1 is connected fixedly in terms of rotation to the camshaft 3*a* by means of a central screw 17.

The stator 2 is configured as a thin-walled sheet metal part, the latter comprising inner circumferential walls 7 and outer circumferential walls 8 which are connected to one another via side walls 9. The inner and the outer circumferential walls 7, 8 extend substantially in the circumferential direction. The stator 2 is mounted rotatably on the output element 3 via the inner circumferential walls 7 which bear against a cylindrical circumferential wall of the output element 3. Starting from the inner circumferential walls 7, the side walls 9 extend substantially in the radial direction outward and merge into the outer circumferential walls 8. As a result of this construction, a plurality of pressure spaces 10 are formed, five in the embodiment shown, which are sealed in a pressuretight manner in the axial direction by the drive wheel 5 and a sealing washer 12.

The vanes 6 are arranged on the outer circumferential surface of the output element 3 in such a way that precisely one vane 6 extends into each pressure space 10. Here, the vanes 6 bear in the radial direction against the outer circumferential walls 8 of the stator 2. The width of the vanes 6 is configured in such a way that they bear in the axial direction against the drive wheel 5 and the sealing washer 12. As a result, each vane 6 divides a pressure space 10 into two pressure chambers 14, 15 which act counter to one another.

The stator 2 and the output element 3 are arranged within a cup-shaped housing 11 which encapsulates these components in a manner which is sealed against pressure medium by the interaction with the drive wheel 5. For this purpose, the open end of the housing 11 is connected to the drive wheel 5 in an oiltight manner. The connection between the drive wheel 5 and the housing 11 can be realized by means of a sealing joining method or by the use of a sealing means. In the embodiment shown, a welded joint 16*a* is provided in the circumferential direction.

An opening 16 which is arranged concentrically with respect to the central hole 4*b* is provided on a base 13 of the housing 11. A central screw 17 penetrates the opening 16 and the central hole 4*b*, a part of the central screw 17 which is provided with a thread engaging into a receptacle 18 of the camshaft 3*a* which is provided with an internal thread. Furthermore, the central screw 17 is provided, on that side of the apparatus 1 which faces away from the camshaft, with a stepped region 19*a*, via which the central screw 17 is supported directly or indirectly on the output element 3 in the mounted state via a separately manufactured screw-on collar 19 and therefore connects said output element 3 fixedly in terms of rotation to the camshaft 3*a*. The advantage of a separately manufactured screw-on collar 19 lies in the relatively low manufacturing complexity and the relatively low manufacturing costs. The central screw 17 which is configured at the same time as a valve housing 22 of a control valve 20 is usually manufactured by a turning process. For reasons of strength, the collar has to be configured with a defined minimum external diameter. As a result of the use of a separate screw-on collar 19, the minimum external diameter of the stepped region 19*a* can be of considerably smaller configuration, as a result of which the manufacturing complexity and therefore the manufacturing costs can be lowered significantly.

The region of the central screw 17 which is arranged within the output element 3 is configured as a control valve 20. Said region of the central screw 17 extends within the central hole 4*b* which acts as a valve receptacle 4*a*.

Figure 3:
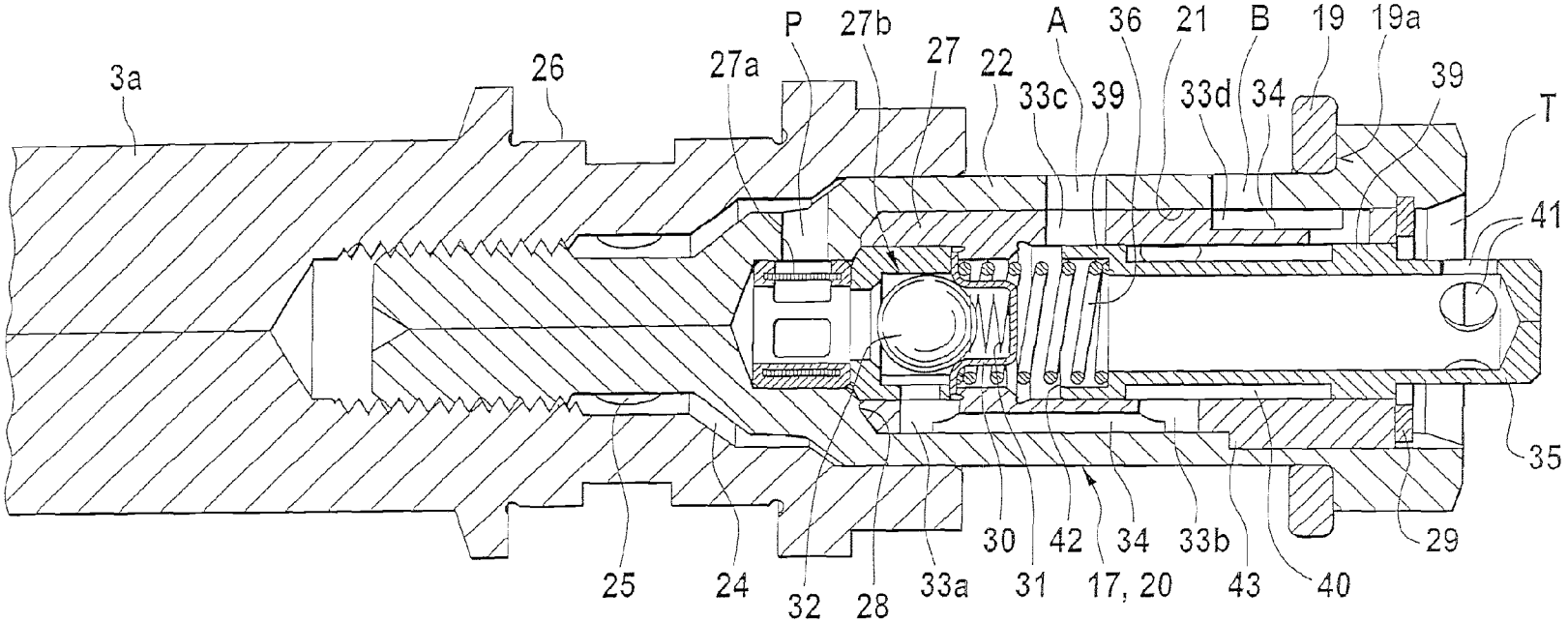
FIG. 3 shows a longitudinal section through a first embodiment of a control valve according to the invention, along the line III-III from FIG. 2*b*.

FIG. 3 shows the central screw 17 in an enlarged form. Said central screw 17 is provided with a receptacle 21 in the manner of a blind hole, the opening of which is arranged at that axial end of the central screw 17 which faces away from the camshaft. The cylindrical circumferential surface of the control valve 20 which is produced as a result fulfills the function of a valve housing 22. Here, the external diameter of the valve housing 22 is adapted to the internal diameter of the output element 3.

The control valve 20 is provided with four connections A, B, P, T, three of the connections A, B, P being formed as radial openings in the cylindrical circumferential surface of the valve housing 22. The inflow connection P is formed on the valve housing 22 in such a way that it is arranged within the receptacle 18 of the camshaft 3*a* in the mounted state of the control valve 20. The receptacle 18 of the camshaft 3*a* is configured in such a way that an annular channel 24 is formed between the central screw 17 and an inner circumferential surface of the receptacle 18, which annular channel 24 is closed by the central screw 17 on the end side of the camshaft. The annular channel 24 communicates firstly with the inflow connection P and secondly via radial holes 25 which are formed on the camshaft 3*a* in the region of a camshaft bearing 26 with a pressure medium pump (not shown).

The inflow connection P and the working connections A, B are arranged offset axially with respect to one another, the inflow connection P being arranged on that side of the working connections A, B which faces the camshaft. This results in the advantage that complicated pressure medium lines within the output element 3 or the valve housing 22, as disclosed in the prior art, can be omitted, which pressure medium lines direct the pressure medium past one of the working connections A, B in the axial direction, without communicating directly with the latter. The pressure medium is conducted, as is still to be described, by means of a pressure medium guide insert 27 within the control valve 20.

As shown in FIG. 2*a*, the working connections A, B communicate with annular channels 3*b* which are formed on the central hole 4*b* of the output element 3 and communicate via pressure medium lines 3*c* with the pressure chambers 14, 15.

A pressure medium guide insert 27 of substantially hollow-cylindrical configuration is arranged within the valve housing 22, the external diameter of the pressure medium guide insert 27 being adapted to the internal diameter of the valve housing 22. At one end, the pressure medium guide insert 27 bears against a shoulder 28 which is configured on the valve housing 22 and, on the other end, is positioned axially within the valve housing 22 by means of a securing ring 29. That axial opening of the pressure medium guide insert 27 which is on the camshaft side is directly connected to the inflow connection P, it being possible, as shown in FIG. 3, for a filter element 27*a* (in this case an annular filter element) and/or a nonreturn valve 27*b* to be arranged between the inflow connection P and the pressure medium guide insert 27. The filter element 27*a* prevents dirt particles from passing into the control valve 20 with the pressure medium which enters into the control valve 20, as a result of which both the control valve 20 and the apparatus 1 are protected effectively against functional disruptions. At various operating points of an internal combustion engine 100, the implementation of the nonreturn valve 27*b* improves the function of the apparatus 1 considerably. The response behavior and the adjusting speed of the apparatus 1 can be increased, and idling of the apparatus 1 during the operating interruptions of the internal combustion engine 100 can be avoided.

A spring bearing 30 is arranged within the pressure medium guide insert 27, which spring bearing 30 closes the axial hole of the pressure medium guide insert 27 in the axial direction in a pressuretight manner and on which spring bearing 30 a spring element 31 is supported which loads a closing body 32 of the nonreturn valve 27*b* with an axial force.

First radial openings 33*a* are provided in the cylindrical circumferential surface of the pressure medium guide insert 27 in the axial direction between that end of the pressure medium guide insert 27 which faces the camshaft 3*a* and the spring bearing 30. Each of the first radial openings 33*a* opens into a pressure medium channel 34 which is configured as a depression which extends in the axial direction and is formed on the outer circumferential surface of the pressure medium guide insert 27. On that side of the spring bearing 30 which faces away from the camshaft 3*a*, each pressure medium channel 34 opens into the interior of the pressure medium guide insert 27 via in each case one second radial opening 33*b*.

Figure 3A:
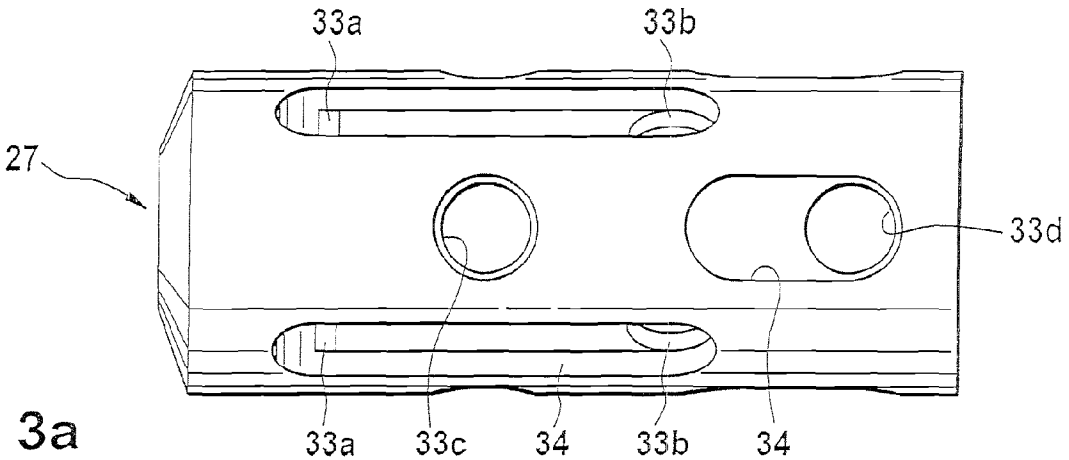
FIG. 3*a* shows the pressure medium guide insert from FIG. 3 in a perspective illustration.

Furthermore, third and fourth radial openings 33*c*, 33*d* are formed on the pressure medium guide insert 27 which communicate with in each case one of the working connections A, B. There is provision here for the third and fourth radial openings 33*c*, 33*d* to be arranged offset in the circumferential direction with respect to one another relative to the first radial openings 33*a*, the second radial openings 33*b* and the pressure medium channels 34 (FIG. 3*a* ). The third and fourth radial openings 33*c*, 33*d* can communicate with the working connections A, B either directly or via further second pressure medium channels 34 which are formed on the pressure medium guide insert 27 and extend substantially axially. As a result, it is possible to arrange the working connections A, B offset with respect to the third and fourth radial openings 33*c*, 33*d*, there being further degrees of freedom in the design of the valve housing 22.

A control plunger 35 of substantially hollow-cylindrical configuration is arranged axially displaceably within the pressure medium guide insert 27. On the camshaft side, the control plunger 35 is loaded with an axial force by means of a plunger compression spring element 36, the plunger compression spring element 36 being supported on a plunger spring bearing 30 which is of one-piece configuration with the spring bearing 30, and the control plunger 35.

As can be seen in FIG. 2*a*, an electric adjusting unit 37 is configured on that side of the control valve 20 which faces away from the camshaft 3*a*, which electric adjusting unit 37 can displace the control plunger 35 in the axial direction via a push rod 38 counter to the force of the plunger compression spring element 36.

The control plunger 35 is configured as a substantially hollow-cylindrical component, two control sections 39 of relatively great external diameter being formed on the outer circumferential surface of said component, which control sections 39 are separated from one another by an annular groove 40. There is provision here for the second radial openings 33*b* to open into the interior of the pressure medium guide insert 27 in the region of the annular groove 40. The external diameter of the control sections 39 is adapted to the internal diameter of the pressure medium guide insert 27, as a result of which pressure medium which is conducted into the annular groove 40 via the second radial openings 33*b* can pass to the pressure medium guide insert 27, to the third or the fourth radial openings 33*c*, 33*d* and therefore to the working connections A, B, as a function of the relative position of the control plunger 35 with respect to the pressure medium guide insert 27.

On the camshaft side, the interior of the control plunger 35 communicates via an axial opening 41 with the interior of the pressure medium guide insert 27 and, on the other side, via radial openings 41 with the exterior of the central screw 17.

In the following text, the method of operation of the control valve 20 will be discussed.

Pressure medium which is conveyed by a pressure medium pump (not shown) can pass into the annular channel 24 via the camshaft bearing 26 and the radial holes 25. From there, the pressure medium enters the interior of the valve housing 22 via the inflow connection P, passes through the filter element 27*a* and passes into the axial hole of the pressure medium guide insert 27 while forcing back the closing body 32. Subsequently, the pressure medium is conducted into the annular groove 40 of the control plunger 35 via the first radial opening 33*a*, the pressure medium channel 34 and the second radial opening 33*b*. As a function of the position of the control plunger 35, the pressure medium then passes via the third or fourth radial openings 33*c*, 33*d* either to the first or to the second working connection A, B and from there to the respective pressure chambers 14, 15 of the apparatus 1. Pressure medium which flows back from the pressure chambers 14, 15 enters the interior of the pressure medium guide insert 27 via the respective working connection A, B and the corresponding radial opening 33*c*, 33*d*. Pressure medium which enters via the working connection A is conducted via the interior of the control plunger 35 and the radial openings 41 to a pressure medium reservoir (not shown) of the internal combustion engine 100. Pressure medium which enters via the working connection B passes directly to the pressure medium reservoir past the control section 39 which faces away from the camshaft 3*a*.

As in the embodiment which is shown in FIG. 3, the pressure medium guide insert 27 can be manufactured in one piece, for example, from a suitable steel, aluminum or plastic. For example, there can be provision here for the pressure medium guide insert 27 to be manufactured by means of a shaping process without cutting or by means of an injection molding process.

In the embodiment which is shown, the spring bearing 30 is configured as a separate component which is fastened subsequently in the hole of the pressure medium guide insert 27. It is conceivable here, for example, to configure the spring bearing 30 as a shaped part without cutting and to connect it to the pressure medium guide insert 27 in a force-transmitting or material-to-material manner. As an alternative, the spring bearing 30 can be encapsulated in the pressure medium guide insert 27 during the injection molding process. A single-piece configuration of the spring bearing 30 with the pressure medium guide insert 27 is likewise conceivable.

As neither the pressure medium guide insert 27 nor the valve housing 22 are of rotationally symmetrical configuration with regard to a longitudinal axis of the control valve 20, antirotation safeguard means for the two components with respect to one another are advantageously provided. This can be realized, for example, by means of a tongue/groove connection 43. At the same time, the tongue/groove connection 43 serves as mounting aid and ensures that the pressure medium guide insert 27 can be mounted within the valve housing 22 only in one orientation, the correct orientation.

The nonreturn valve 27*b* and the filter element 27*a* can be configured separately with respect to the pressure medium guide insert 27 or in one piece with the latter. In the case of a separate configuration, it is proposed to connect the filter element 27*a* and the nonreturn valve 27*b* to the pressure medium guide insert 27 by means of a material-to-material connection, such as ultrasonic welding.

Figure 4:
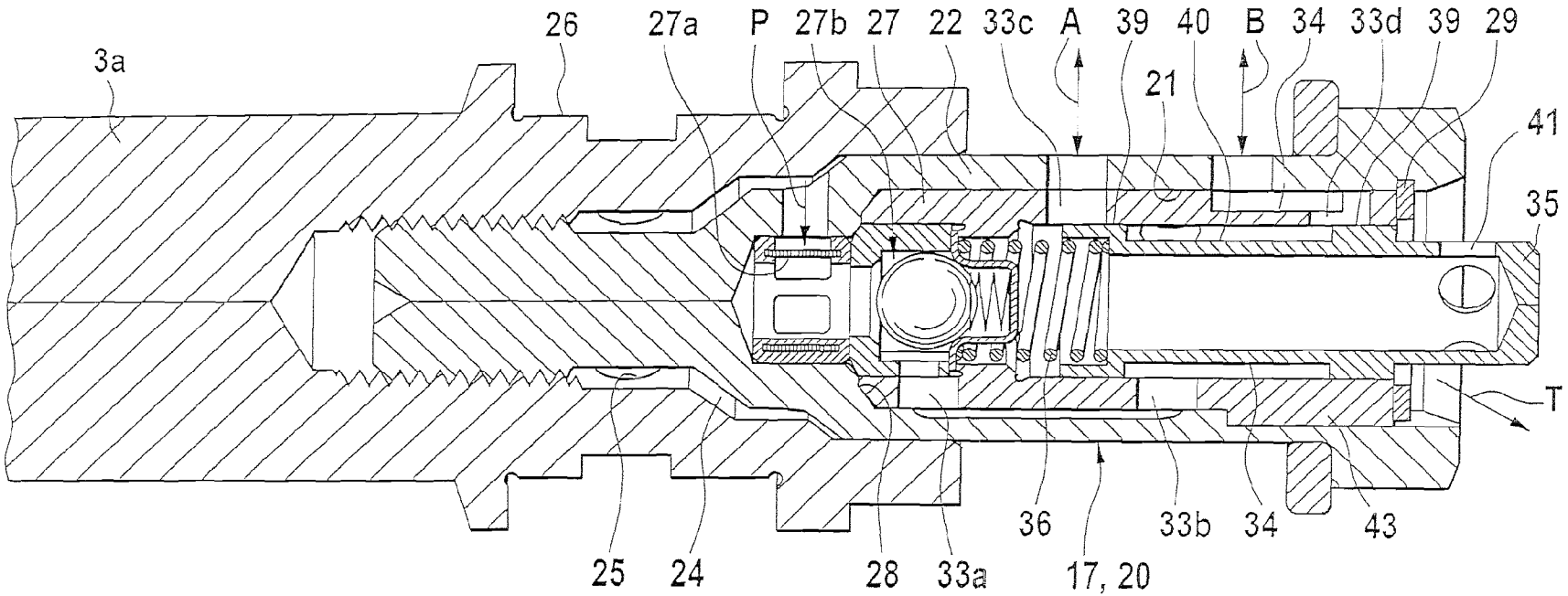
FIG. 4 shows a longitudinal section through a second embodiment of a control valve according to the invention.

FIG. 4 shows a further embodiment according to the invention of a control valve 20, the latter being identical in large parts to the embodiment which is shown in FIG. 3. In contrast to the first embodiment, the pressure medium channels 34 in this embodiment are formed as depressions or longitudinal grooves on the inner circumferential surface of the valve housing 22. Only the radial openings 33*a*-33*d* are formed on the pressure medium guide insert 27.

Figure 5:
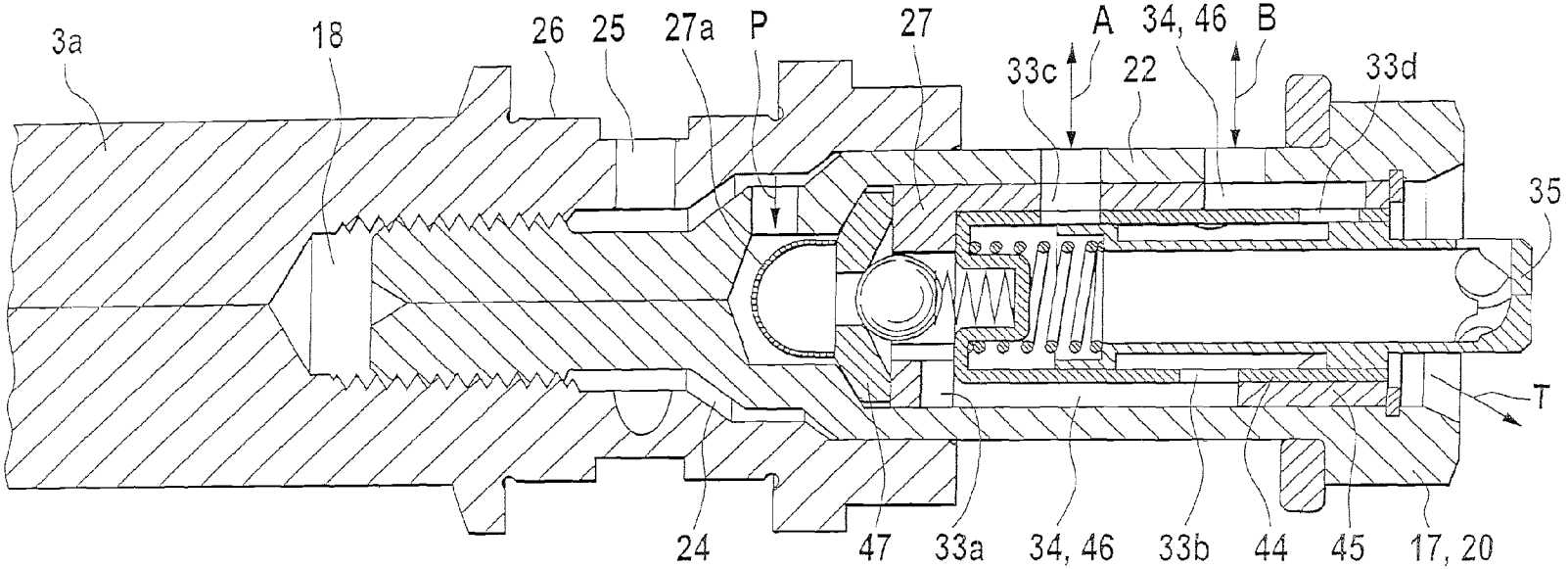
FIG. 5 shows a longitudinal section through a third embodiment of a control valve according to the invention.
Figure 5A:
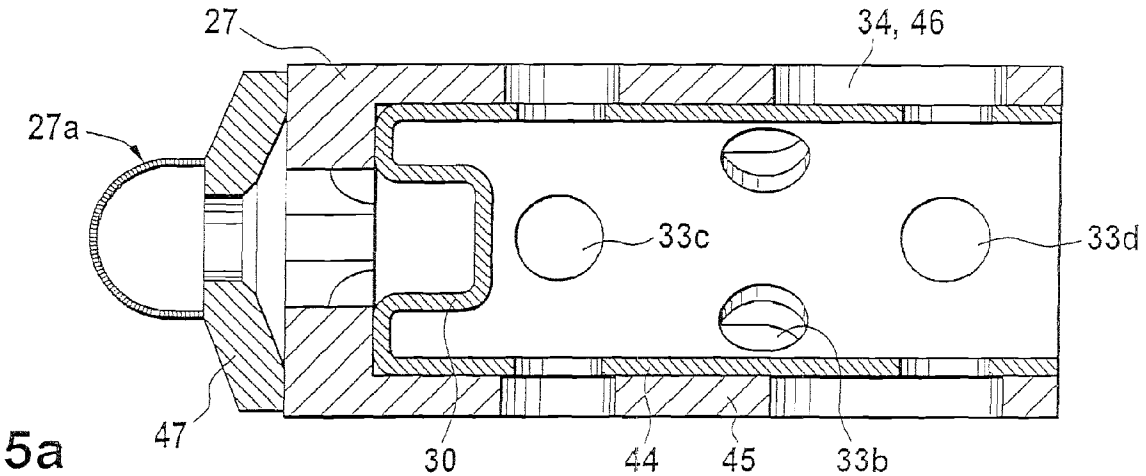
FIG. 5*a* shows a longitudinal section through the pressure medium guide insert from FIG. 5.

FIG. 5 shows a further embodiment according to the invention of a control valve 20, the pressure medium guide insert 27 being configured in two pieces in this case, in the form of an inner and an outer sleeve-shaped component 44, 45. Both the inner and the outer sleeve-shaped components 44, 45 have the third radial openings 33*c* which are oriented toward one another. The fourth radial openings 33*d* are formed only in the inner sleeve-shaped component 44 and open into second pressure medium channels 34 which are formed on the outer sleeve-shaped component 45. The first radial openings 33*a* are formed exclusively in the outer sleeve-shaped component 45, and the second radial openings 33*b* are formed exclusively in the inner sleeve-shaped component 44. Both the first and the second radial openings 33*b* open into the pressure medium channels 34. In this case, the latter are configured as slots 46 which are formed on the circumferential surface of the outer sleeve-shaped component 45. The pressure medium channels 34 are delimited radially outward by the inner circumferential surface of the valve housing 22 and radially inward by the inner sleeve-shaped component 44. FIG. 5*a* shows the pressure medium guide insert 27 of the embodiment (shown in FIG. 5) of a control valve 20 in an enlarged sectional illustration, the sectional plane deviating from that in FIG. 5. In this embodiment, the spring bearing 30 can be configured both as a separate component, as shown in FIG. 5, or in one piece with the inner sleeve-shaped component 44, as shown in FIG. 5*a*. The one-piece embodiment can be manufactured, for example, by means of a forming process without cutting from a suitable sheet metal blank.

In the embodiment of a pressure medium guide insert 27 which is shown in FIG. 5*a*, the filter element 27*a* is configured separately from the former, a frame 47 of the filter element 27*a* being connected to the pressure medium guide insert 27 by means of a material-to-material connection. In the embodiment which is shown, the frame 47 of the filter element 27*a* acts as a valve seat for a closing body 32 (not shown).

In one preferred embodiment, the outer sleeve-shaped component 45 is manufactured as a plastic injection molded part, the inner sleeve-shaped component 44 which is manufactured from a steel sheet being encapsulated by the outer sleeve-shaped component 45 during the injection molding process of the latter.

Various other material pairings are likewise conceivable, force-transmitting, material-to-material or form-fitting connections being suitable between the two sleeve-shaped components 44, 45.

As a result of the use of the proposed pressure medium guide insert 27 between the valve housing 22 and the control plunger 35 of a control valve 20, and as a result of the formation of substantially axially extending pressure medium channels 34 within the control valve 20, practically any desired oil logics can be realized between connections A, B, P, T with the aid of the pressure medium guide insert 27, without the axial installation space requirement, the manufacturing complexity and the manufacturing costs of the control valve 20 being increased significantly. The required pressure medium channels 34 can be made in the pressure medium guide insert 27 in a cost-neutral manner during the forming process of the latter.

In addition to the embodiments which are shown in the exemplary embodiments, it would likewise be conceivable, for example, for the pressure medium channels 34 to connect the outflow connection T to the interior of the pressure medium guide insert 27, while pressure medium can be conducted via an axial inflow connection P within the control plunger 35 either to the working connection A or the working connection B.

In addition to the connection of the working connection P to the interior of the pressure medium guide insert 27 via first pressure medium channels 34, the working connections A, B can communicate via second pressure medium channels 34 and the third and fourth radial openings 33*c*, 33*d* with the interior of the pressure medium guide insert 27, as shown, for example, in FIGS. 3 and 3*a*.

The manufacturing complexity of the pressure medium guide insert 27 can be reduced further by the formation of the pressure medium channels 34 at an interface between the pressure medium guide insert 27 and the valve housing 22. Furthermore, further materials, such as steel sheets, can be used for manufacturing the pressure medium guide insert 27.

The use of the pressure medium channels 34 which are simple to form and inexpensive to manufacture at the interface between the pressure medium guide insert 27 and the valve housing 22 makes it possible to represent a very wide variety of oil logics. At the same time, the degrees of freedom in the design of the individual components of the control valve 20, such as the valve housing 22, are increased significantly.

Instead of the otherwise customary complex structural measures in the surrounding constructions of the control valve 20 or in the control valve 20 itself, in order to connect the inflow connection P which is usually arranged between the two working connections A and B to the pressure medium pump, the volumetric flow is conducted in this exemplary embodiment by means of a pressure medium guide insert 27 which is inexpensive to manufacture within the control valve 20.

Specifically in the case of central valves, this has the advantage that the proven internal embodiment of the control valve 20 can be retained, it being possible for complicated and expensive pressure medium guides within the output element 3 of the apparatus 1 or a camshaft 3*a* or the valve housing 22 of the control valve 20 to be omitted.

The pressure medium channels 34 which are formed in the pressure medium guide insert 27 permit the arrangement of the connections A, B, P, T in almost any desired location on the valve housing 22. The valve housing 22 can therefore be adapted to the surrounding construction and not vice versa.

Furthermore, the performance of the control valve 20 and therefore of the apparatus 1 which is actuated by the control valve 20 can be increased by the integration of further functionalities into the pressure medium guide insert 27, such as filter elements 27*a* or nonreturn valves 27*b*. Here, the costs and the mounting complexity are scarcely increased as a result of the integration of the additional functions. With a corresponding design of the pressure medium guide insert 27 and the valve receptacle 4*a*, an embodiment without a valve housing 22 would likewise be conceivable. In this case, the pressure medium channels 34 would be formed at an interface between the pressure medium guide insert 27 and the surrounding construction, for example at the output element 3, a camshaft 3*a* which engages into the output element 3, or a valve receptacle which is formed on a cylinder head or a cylinder head cover. In the case of a central valve, it would have to be ensured that the control valve 20 communicates with all pressure medium lines 3*c* of all pressure chambers.

This could be achieved, for example, by either a third or fourth radial opening 33*c*, 33*d* being formed on the pressure medium guide insert 27 per pressure medium line 3*c*; said radial openings 33*c*, 33*d* would have to be oriented with respect to the openings of the pressure medium lines 3*c*. A further possibility consists in forming only one pressure medium channel 34 which connects the inflow connection P to the interior of the pressure medium guide insert 27. In this case, two circumferential grooves which are offset axially with respect to one another and communicate in each case firstly with the third or fourth radial openings 33*c*, 33*d* and secondly with the pressure medium lines 33*c* of the first or second pressure chambers 14, 15 can be provided on the residual circumferential surface of the pressure medium guide insert 27.

LIST OF DESIGNATIONS

1 Apparatus
1*a* Adjusting apparatus
2 Stator
3 Output element
3*a* Camshaft
3*b* Annular channel
3*c* Pressure medium line
4 Wheel hub
4*a* Valve receptacle
4*b* Central hole
5 Drive wheel
6 Vane
7 Inner circumferential wall
8 Outer circumferential wall
9 Side wall
10 Pressure space
11 Housing
12 Sealing washer
13 Base
14 First pressure chamber
15 Second pressure chamber
16 Opening
16*a* Welded joint
17 Central screw
18 Receptacle
19 Screw-on collar
19*a* Stepped region
20 Control valve
21 Receptacle
22 Valve housing
24 Annular channel
25 Radial hole
26 Camshaft bearing
27 Pressure medium guide insert
27*a* Filter element
27*b* Nonreturn valve
28 Shoulder
29 Securing ring
30 Spring bearing
31 Spring element
32 Closing body
33*a* First radial opening
33*b* Second radial opening
33*c* Third radial opening
33*d* Fourth radial opening
34 Pressure medium channel
35 Control plunger
36 Plunger compression spring element
37 Adjusting unit
38 Push rod
39 Control section
40 Annular groove
41 Opening
43 Tongue/groove connection
44 Inner sleeve-shaped component
45 Outer sleeve-shaped component
46 Slot
47 Frame
100 Internal combustion engine
101 Crankshaft
102 Plunger
103 Cylinder
104 Flexible drive
105 Flexible drive
106 Inlet camshaft
107 Outlet camshaft
108 Cam
109 Cam
110 Inlet gas exchange valve
111 Outlet gas exchange valve
A Working connection
B Working connection
P Inflow connection
T Outflow connection

The invention claimed is:

1. A control valve for an apparatus for the variable setting of the control times of gas exchange valves of an internal combustion engine comprising:

a valve housing of hollow configuration, which has at least one inflow connection, at least one outflow connection and at least two working connection, a control plunger, a pressure medium guide insert of hollow configuration arranged within the valve housing, the external dimensions of the pressure medium guide insert being adapted to the internal dimensions of the valve housing, at least one pressure medium channel formed at the interface between the valve housing and the pressure medium guide insert and which extends substantially in the axial direction, the pressure medium guide insert engaging around the pressure medium channel at least partially, the pressure medium channel communicating with at least one of the connections and, via a radial opening, with the interior of the pressure medium guide insert, and the control plunger being arranged within the pressure medium guide insert.

2. The control valve of claim 1, wherein the at least one pressure medium channel is configured as a depression on an inner circumferential surface of the valve housing, an outer circumferential surface of the pressure medium guide insert delimiting the pressure medium channel radially inward, and the interior of the pressure medium guide insert communicating with the pressure medium channel via a radial opening which is formed on said pressure medium guide insert.

3. The control valve of claim 1, wherein the at least one pressure medium channel is configured as a depression on an outer circumferential surface of the pressure medium guide insert, an inner circumferential surface of the valve housing delimiting the pressure medium channel radially outward, and the pressure medium channel communicating with the interior of the pressure medium guide insert via a radial opening which is formed on said pressure medium guide insert.

4. The control valve of claim 1, wherein the pressure medium guide insert comprises at least one inner and one outer sleeve-shaped component, and in that the at least one pressure medium channel is configured as a slot in a wall of the outer sleeve-shaped component of the pressure medium guide insert, an inner circumferential surface of the valve housing delimiting the pressure medium channel radially outward and the inner sleeve-shaped component of the pressure medium guide insert delimiting the pressure medium channel radially inward, and the pressure medium channel communicating with the interior of the pressure medium guide insert via a radial opening which is formed on the inner sleeve-shaped component.

5. The control valve of claim 1, wherein the pressure medium guide insert is configured in one piece and from steel.

6. The control valve of claim 1, wherein the pressure medium guide insert is configured in one piece and from plastic.

7. The control valve of claim 4, wherein the inner sleeve-shaped component is manufactured separately with respect to the outer sleeve-shaped component and is connected to the latter by means of a force-transmitting or form-fitting connection or an adhesive bond.

8. The control valve of claim 4, wherein the outer sleeve-shaped component is manufactured as an injection molded part and the inner sleeve-shaped component is configured as an insert component which is encapsulated by the outer sleeve-shaped component during the injection molding process of the latter.

9. The control valve of claim 1, wherein the pressure medium channel connects the inflow connection to the interior of the pressure medium guide insert.

10. The control valve of claim 9, wherein a nonreturn valve is arranged within the control valve upstream of the pressure medium channel.

11. The control valve of claim 9, wherein a filter element is arranged within the control valve upstream of the pressure medium channel.

12. The control valve or claim 10, wherein the nonreturn valve has a closing body which is loaded with a force by a spring element, the spring element being supported on a spring bearing which is configured in one piece with the pressure medium guide insert.

13. The control valve of claim 10, wherein the nonreturn valve has a closing body which is loaded with a force by a spring element, a spring bearing and a valve seat, at least the spring bearing or the valve seat being configured as a component which is separate from the pressure medium guide insert.

14. The control valve of claim 1, wherein a plunger compression spring element is provided which loads the control plunger with a force in an axial direction, aid plunger compression spring element being supported on a plunger spring bearing which is configured in one piece with the pressure medium guide insert.

15. The control valve of claim 1, wherein a plunger compression spring element is provided which loads the control plunger with a force in an axial direction, aid plunger compression spring element being supported on a plunger spring bearing which is configured separately from the pressure medium guide insert.

16. The control valve of claim 1, wherein both a plunger spring bearing and a spring bearing which is configured in one piece with the former are provided.

17. The control valve of claim 12 wherein the filter element and/or parts of the nonreturn valve are/is connected to the pressure medium guide insert with a material-to-material fit.

18. The control valve claim of 1, wherein the pressure medium guide insert is arranged within the valve housing in a stationary manner with respect to the valve housing.

19. The control valve of claim 18, wherein form-fitting means are provided on the pressure medium guide insert and on the valve housing, which form-fitting means serve to fix the pressure medium guide insert axially with respect to the valve housing and/or to fix it in a stationary manner in the circumferential direction.

20. A control valve for an apparatus for the variable setting of the control times of gas exchange valves of an internal combustion engine comprising:

a valve housing of hollow configuration, which has at least one inflow connection, at least one outflow connection and at least two working connection, wherein the apparatus is fastened to a camshaft by means of a central screw, and the valve housing is configured in one piece with the central screw;

a control plunger;

a pressure medium guide insert of hollow configuration arranged within the valve housing;

at least one pressure medium channel which extends substantially in the axial direction; the pressure medium guide insert engaging around the pressure medium channel at least partially;

the pressure medium channel communicating with at least one of the connections and, via a radial opening, with the interior of the pressure medium guide insert; and the control plunger being arranged within the pressure medium guide insert.

* * * * *